US005118587A

United States Patent [19]

Takaragi et al.

[11] Patent Number: 5,118,587

[45] Date of Patent: Jun. 2, 1992

[54] MAGNETIC PARTICLES USED FOR ELECTROSTATIC LATENT IMAGE DEVELOPER AND PROCESS FOR PRODUCING THE SAME

[75] Inventors: Shigeru Takaragi; Toshiyuki Hakata; Kazuo Fujioka; Tetsuro Toda, all of Hiroshima, Japan

[73] Assignee: Toda Kogyo Corporation, Hiroshima, Japan

[21] Appl. No.: 553,807

[22] Filed: Jul. 18, 1990

[30] Foreign Application Priority Data

Jul. 28, 1989 [JP] Japan ..... 1-197432
Nov. 8, 1989 [JP] Japan ..... 1-291691

[51] Int. Cl.[5] ..... G03G 9/083

[52] U.S. Cl. ..... 435/106.6; 430/109; 430/111; 430/903

[58] Field of Search ..... 430/111, 109, 106.6, 430/903; 524/841, 779

[56] References Cited

U.S. PATENT DOCUMENTS

| | | | |
|---|---|---|---|
| 3,533,835 | 10/1970 | Hagenbach et al. | 430/111 |
| 3,960,805 | 6/1976 | Taylor | 524/841 X |
| 4,543,312 | 9/1985 | Murakawa | 430/903 X |
| 4,640,971 | 5/1987 | Echigo et al. | 528/129 |
| 4,788,236 | 11/1988 | Kopf | 524/841 X |
| 4,839,445 | 1/1989 | Echigo et al. | 525/503 |

FOREIGN PATENT DOCUMENTS

| | | |
|---|---|---|
| 61-51019 | 2/1986 | Japan . |
| 62-27455 | 6/1987 | Japan . |

*Primary Examiner*—Roland Martin
*Attorney, Agent, or Firm*—Nixon & Vanderhye

[57] ABSTRACT

Disclosed herein are magnetic particles used for an electrostatic latent image developer comprising composite particles containing from more than 80% by weight to not more than 99% by weight of fine ferromagnetic particles and a cured phenol resin, and having a number-average particle diameter of from not less than 1 μm to less than 10 μm and an apparent density of not greater than 1.5 g/cm$^3$.

4 Claims, 1 Drawing Sheet (X10000)

(X10000)

(X10000)

MAGNETIC PARTICLES USED FOR ELECTROSTATIC LATENT IMAGE DEVELOPER AND PROCESS FOR PRODUCING THE SAME

BACKGROUND OF THE INVENTION

The present invention relates to magnetic particles used for an electrostatic latent image developer comprising fine ferromagnetic particles and a phenol resin, as well as a process for producing the same. More in particular, it relates to magnetic particles used for an electrostatic latent image developer having an average particle diameter of not less than 1 μm to less than 10 μm and showing excellent bondability between each of fine ferromagnetic particles, as well as a process for producing the same.

Heretofore, as one of developing methods for electrostatic latent images, a developing method with a so-called one component-type magnetic toner using as a developer, composite particles comprising fine ferromagnetic particles mixed and dispersed in a resin, without using a carrier has been generally known and put to practical use.

For the magnetic toner, an electroconductive magnetic toner prepared by adding an electroconductive material such as carbon black to fine ferromagnetic particles and a resin has generally been known. In the developing method of using the electroconductive magnetic toner, the magnetic toner is held on a non-magnetic sleeve by a magnetic force of a magnet roller and is electrostatically charged to a polarity opposite to that of a latent image by means of electrostatic induction when the toner is brought closer to the latent image, and then the magnetic toner charged to the opposite polarity is deposited to and developed on the surface of the latent image overcoming the magnetic attraction.

The image developed by using the electroconductive magnetic toner described above has a problem in that electrostatical transfer on other recording member is difficult. For overcoming such drawback, there has been proposed a method of conducting development by using a magnetic toner of high electric resistivity of not less than $10^{12}$ ohm.cm of volumic electric resistance instead of the conductive toner.

However, although the developing method by using the magnetic toner of high electric resistivity can improve the transferability, it has been pointed out that the developability is worsened.

In view of the above, Japanese Patent Application Laid-Open (KOKAI) 56-142540 has proposed a method of improving both the transferability and developability by using a mixture of a magnetic toner of high electric resistivity and a magnetic particles having the average particle diameter of smaller than that of the magnetic toner.

As various properties of the magnetic particles used in the proposed method, it is strongly demanded that the particles have average particle diameter of not less than 1 μm to less than 10 μm and have such a softness as not causing injuries to a roller upon fixing an image by means of the roller, that is, a softness about not greater than 1.5 g/cm$^3$ as expressed by an apparent density and a volumic electric resistivity of less than $10^{12}$ ohm.cm, particularly not greater than $10^9$ ohm.cm. More preferably, it is required that the magnetic particles have excellent fluidity.

The fact that particles with an average particle diameter of not less than 1 μm to less than 10 μm are required for the magnetic particles, is apparent from that the one component-type magnetic toners used at present have average particle diameter from 5 to 20 μm and from the descriptions in Japanese Patent Application Laid-Open (KOKAI) 56-142540 that "the conductive magnetic particles have a volume average particle diameter of about from 1/5 to 4/5 of that of the magnetic toner, preferably, to be selected about from 3/10 to $\frac{2}{3}$", because as described in the above-mentioned Japanese patent (KOKAI), "it is important in the developer according to the present invention that the average particle diameter of the conductive magnetic particles **5*b* is to be made smaller than that of the magnetic toner 5*a* of high electric resistivity. If the magnetic particles 5*b* are greater than the magnetic toner 5*a***, the periphery of the magnetic particles is covered with the smaller magnetic toner. Since the magnetic attraction to the magnet 6 is increased as the magnetic particles become larger, magnetic particles carrying the magnetic toner therearound are just removed from the electrostatic latent images to cause white spots referred to as blanking on the image. . . . On the other hand, if the conductive magnetic particles are too small, it is neither preferred. That is, if the particle size is too small, fine magnetic particles are attracted strongly to the periphery of the magnetic toner by means of van der Waals force to form the similar structure to that in the conventional conductive magnetic toner made conductive at the periphery thereof, thereby worsening the electrostatic transferability".

In addition, as stated in the above-mentioned Japanese patent (KOKAI) "in the present invention, the electroconductivity of the conductive magnetic particles is defined as that the volumic electric resistivity is not greater than $10^9$ ohm.cm, whereas the high electric resistance of the magnetic toner is defined that the volumic electric resistivity is not less than $10^{12}$ ohm.cm, . . .", the electric resistance of the magnetic particles is required to have an electric resistance lower than that of the magnetic toner with high electric resistivity of not less than $10^{12}$ ohm.cm, that is, an electric resistivity of not less than $10^{12}$ ohm.cm, preferably not greater than $10^9$ ohm.cm.

Referring further to the fluidity, it has been known that the fluidity of the developer controls the behavior of the developer in a developing machine and gives undesired effect on the charging characteristics of the developer. As a result, if the fluidity is poor, for instance, unevenness tends to occur in the image and, in an extreme case, this causes a trouble such as the image is not obtainable. Accordingly, improvement in the fluidity of the magnetic particles is also demanded.

As magnetic particles, coagulated particles prepared (i) by washing fine ferromagnetic particles sufficiently with water and, subsequently, rapidly drying them under stirring in a drier, or (ii) by fluidizing the fine ferromagnetic particles in a fluidized layer and spraying organic polymeric material, etc. to the particles, as described in Japanese Patent Application Laid-Open (KOKAI) 56-159653.

Magnetic particles having an average particle diameter of from not less than 1 μm to less than 10 μm, an apparent density of not greater than about 1.5 g/cm$^3$ and a volumic electric resistivity of less than $10^{12}$ ohm.cm are most strongly demanded at present. However, although coagulated particles with the apparent density not greater than about 1.5 g/cm$^3$ can be obtained by any one of the known methods described above, since particle control is difficult and a great amount of coagulated particles with the average particle diameter of not less than 10 μm are present together, the particle size distribution is wide and the particles can not be used unless they are classified.

In particular, in the case of using the method as defined in the (i), since the fine ferromagnetic particles are merely coagulated by drying, the coagulation is easily disintegrated, so that a great amount of fine powder of not greater than 1 μm are mixed together, making the particle size distribution broader.

In the case of using the method as defined in the (ii), since the organic polymeric material as the binder is present between each of the fine ferromagnetic particles, coagulated particles formed are not easily disintegrated. On the other hand, the ratio of the organic polymeric material in the coagulated particles is increased to result in a drawback that the volumic electric resistivity is increased to not greater than $10^{12}$ ohm.cm.

That is, the amount of the organic polymeric material contained in the magnetic particles has to be minimized while considering the bondability between each of the fine ferromagnetic particles and the electric resistance.

Composite particles comprising fine ferromagnetic particles and an organic polymeric material such as a resin have been generally known so far and they are obtained, for example, by mixing the fine ferromagnetic particles and the resin each in a predetermined amount in a molten resin and, subsequently, pulverizing the obtain mixture as described in Japanese Patent Application Laid-Open (KOKAI) 59-31967. However, the content of the fine ferromagnetic particles is generally less than 80% by weight and the content of the fine ferromagnetic particles can be increased no more, and accordingly, it is difficult to obtain composite particles with the electric resistivity of less than $10^{12}$ ohm.cm by reducing the resin content.

It is, therefore, strongly demanded to provide composite particles having an average particle diameter of from not less than 1 μm to less than 10 μm and an apparent density of not greater than 1.5 g/cm$^3$, the content of the fine ferromagnetic particles being increased as much as possible.

As a result of the present inventors earnest studies, it has been found that composite particles comprising fine ferromagnetic particles and a phenol resin prepared by reacting phenols and aldehydes in an aqueous medium under the presence of fine ferromagnetic particles and a basic catalyst to form fine composite particles comprising fine ferromagnetic particles and a cured phenol resin, in which the concentration of the fine ferromagnetic particles is controlled or the surface of the ferromagnetic particles is made hydrophobic, have a number-average particle diameter of from not less than 1 μm to less than 10 μm, an apparent density of not greater than 1.5 g/cm$^3$ and the content of the fine ferromagnetic particles of from more than 80% by weight to not more than 99% by weight, and is useful as magnetic particles for an electrostatic latent image developer. The present invention has been attained based on such a finding.

SUMMARY OF THE INVENTION

Figure 1:
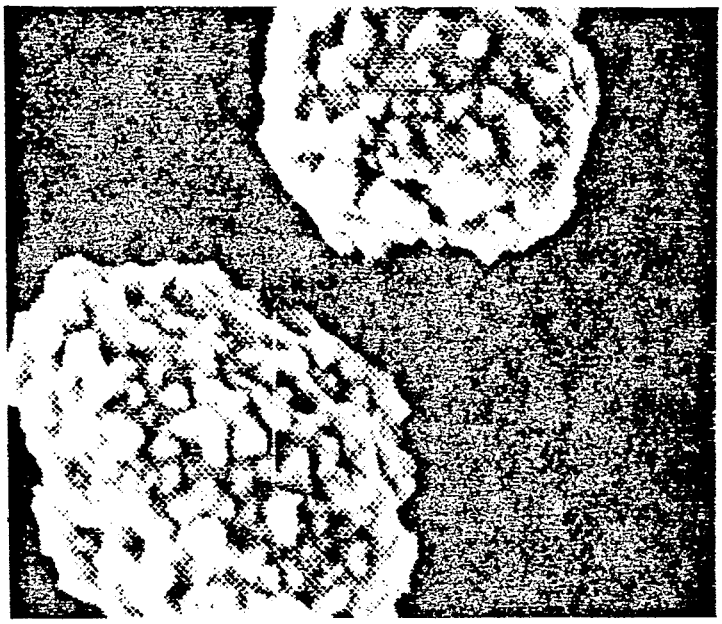
FIGS. 1 and 2 are scanning type electron microscopic photograph (×10,000) showing the particle structure of composite particles in Examples 3 and 8 of the present invention.

In a first aspect of the present invention, there is provided magnetic particles used for an electrostatic latent image developer comprising composite particles containing from more than 80% by weight to not more than 99% by weight of fine ferromagnetic particles and a cured phenol resin, and having a number-average particle diameter of from not less than 1 μm to less than 10 μm and an apparent density of not greater than 1.5 g/cm$^3$.

In a second aspect of the present invention, there is provided magnetic particles used for an electrostatic latent image developer comprising composite particles containing from more than 80% by weight to not more than 99% by weight of fine ferromagnetic particles subjected at the surface thereof to a hydrophobic treatment and a cured phenol resin, and having a number-average particle diameter of from not less than 1 μm to less than 10 μm and an apparent density of not greater than 1.5 g/cm$^3$.

In a third aspect of the present invention, there is provided a process for producing magnetic particles as defined in the first aspect, comprising reacting phenols and aldehydes in an aqueous medium under the presence of fine ferromagnetic particles and a basic catalyst, the concentration of the fine ferromagnetic particles in the aqueous medium being not greater than 65% by weight.

In a fourth aspect of the present invention, there is provided a process for producing magnetic particles as defined in the second aspect, comprising reacting phenols and aldehydes in an aqueous medium under the presence of fine ferromagnetic particles and a basic catalyst, the fine ferromagnetic particles being subjected at the surface thereof to hydrophobic treatment.

DETAILED DESCRIPTION OF THE INVENTION

The number-average particle diameter of the composite particles according to the present invention is from not less than 1 μm to less than 10 μm. If it is less than 1 μm or not less than 10 μm, it is not preferred for the magnetic particles used for an electrostatic development as an object of the present invention. Since the particle diameter of the magnetic particles has a close relation with the particle diameter of the magnetic toner used together it may be properly selected within a range from not less than 1 μm to less than 10 μm, preferably from 2 to 8 μm.

The apparent density of the composite particles according to the present invention is not greater than 1.5 g/cm$^3$. The low apparent density enables to provide higher image quality and, since the particles are of low apparent density and soft, they do not injure a roller, etc. upon fixing by the roller.

The electric resistivity of the magnetic particles comprising the composite particles according to the present invention, as expressed by the volumic electric resistivity, is less than $10^{12}$ ohm.cm, preferably not greater than $10^9$ ohm.cm.

Further, the composite particles according to the present invention is excellent in the fluidity and the fluidizing rate is, for example, not less than 0.45 g/sec, preferably, not less than 0.48 g/sec.

The content of the fine ferromagnetic particles in the composite particles according to the present invention is from more than 80% by weight to not more than 99% by weight, preferably from 82 to 95% by weight. If it is not greater than 80% by weight, the content of the insulative resin component is increased, failing to obtain composite particles with the volumic electric resistivity of less than $10^{12}$ ohm.cm. If it exceeds 99% by weight, bonding force between each of the fine ferromagnetic particles is reduced and fine ferromagnetic particles are separated individually to increase the amount of fine particles having less than 1 μm of particle diameter.

As the fine ferromagnetic particles usable in the present invention, fine iron oxide particles of magnetite and maghemite, spinel ferrite containing one or more of metals other than iron (Mn, Ni, Zn, Mg, Cu, etc.), magnetoplumbite type ferrite such as barium ferrite, as well as iron or alloy having an oxide layer on the surface thereof may be exemplified. In addition, oxides of metals other than iron (Mn, Ni, Zn, Mg, Cu, etc.) can also be incorporated together with fine ferromagnetic particles. The shape of the fine ferromagnetic particles may be granular, spherical or acicular. Further, composite particles having desired saturation magnetization can be obtained by properly selecting the kind and the content of the fine ferromagnetic particles. For instance, (1) in a case of obtaining saturation magnetization of from 40 to 70 emu/g, magnetoplumbite type ferrite such as barium ferrite or spinel ferrite may be used. (2) In a case of obtaining high saturation magnetization about from 70 to 100 emu/g, magnetite of Zn-containing spinel ferrite may be used. Further, (3) in a case of obtaining higher saturation magnetization of greater than 100 emu/g, fine particles of iron or alloy having an oxide layer on the surface thereof may be used.

The particle size of the fine ferromagnetic particles used in the present invention is preferably about from 0.01 to 0.3 μm. The content of the fine ferromagnetic particles is preferably from 0.5 to 200 times by weight based on the amount of the phenols. Further, in the consideration of the saturation magnetization and the strength of the particles of the resultant composite particles, the content of the fine ferromagnetic particle is preferably from 4 to 100 times by weight based on the amount of the phenols.

The content of a cured phenol resin in the composite particles according to the present invention is particularly preferably from not less than 1% by weight to less than 20% by weight.

In the present invention, in case of using fine ferromagnetic particles subjected at the surface thereof to hydrophobic treatment, composite particles with an average particle diameter from not less than 1 μm to less than 10 μm can be obtained without controlling the concentration of the fine ferromagnetic particles to the specified narrow range as described later.

The fine ferromagnetic particles subjected at the surface thereof to a hydrophobic treatment in the present invention can be obtained by any of methods such as a method of simply mixing fine ferromagnetic particles and a hydrophobic treating agent, or a method of mixing fine ferromagnetic particles and a hydrophobic treating agent in an aqueous medium thereby adsorbing the hydrophobic treating agent to the surface of the particles.

As the hydrophobic treating agent, there can be used a coupling agent such as titanates, silanes or like, silylating agent, silicone oil, as well as various kinds of surfactants.

As the titanates coupling agent, there can be mentioned, for example, isopropyltrisostearoyl titanate, isopropyltridecylbenzene sulfonyl titanate, isopropyltris(dioctylpyrophosphate) titanate, bis(dioctylpyrophosphate) oxyacetate titanate and bis(dioctylpyrophosphate) ethylene titanate.

As the silanes coupling agent there can be mentioned, for example, vinyl trichlorosilane, vinyltriethoxysilane, vinyl tris(β-methoxyethoxy)silane, γ-glycidoxypropyltrimethoxysilane, γ-glycidoxypropylmethyldiethoxysilane, γ-aminopropyltriethoxysilane and N-β(aminoethyl)-γ-aminopropyltrimethoxysilane.

As the silylating agent, there can be mentioned, for example, hexamethyldisilazane, trialkylalkoxysilane and trimethylethoxysilane.

As the silicone oil, there can be mentioned, for example, dimethyl silicone oil, methyl hydrogenated silicone oil, etc.

As the surfactant, any of commercially available surfactants may be used and those having functional groups capable of coupling with hydroxyl groups present at the surface of fine ferromagnetic particles are preferred. In view of the ionic property, cationic or anionic surfactant is preferable.

The treatment with the hydrophobic treating agent is preferably applied such that the hydrophobic degree of the fine ferromagnetic particles is from 20 to 60% by weight, preferably, from 25 to 55% by weight. If the degree is less than 20% by weight, the hydrophobic effect for the fine ferromagnetic particles is not sufficient, failing to obtain electroconductive magnetic particles of excellent fluidity, which is an object of the present invention. If it exceeds 60% by weight, it is difficult to obtain composite particles with an average particle diameter of from not less than 1 μm to less than 10 μm, at a high yield.

As the basic catalyst used for reacting phenols and aldehydes in the present invention, those basic catalysts usually used for the production of resol resins can be used. There can be mentioned, for example, aqueous ammonia or alkylamine such as hexamethylene tetramine, diethylene triamine or polyethylene imine. The molar ratio of the basic catalyst to the phenols is not less than 0.4, preferably 0.4 to 2.0, when considering the particle diameter of the resultant composite particles.

As the phenols used in the present invention, there can be mentioned phenol, those compounds having phenolic hydroxy groups such as alkylphenols, for example, m-cresol, p-tert-butylphenol, o-propylphenol, resolsinol or bisphenol A, and halogenated phenols in which a benzene ring or alkyl group is partially or entirely substituted with chlorine or bromine atom. Among them, phenol is most preferred.

As the aldehydes used in the present invention, there can be mentioned, for example, formaldehyde in the form of formalin or paraformaldehyde, and fulfural. Formaldehyde is particularly preferred.

The molar ratio of the aldehydes based on the phenols is from 1 to 4, preferably from 1.2 to 3 considering the particle diameter of the resultant composite particles. If the molar ratio of the aldehydes to the phenols is less than 1, the composite particles can not be formed easily, or if they are formed, the strength of the resin tends to be reduced. On the other hand, if the molar ratio of the aldehydes to the phenols is more than 4, more unreacted aldehydes tend to remain in the aqueous medium after the reaction.

The concentration of the fine ferromagnetic particles in the present invention is such that the average particle diameter of the resultant fine composite particles is from not less than 1 μm to less than 10 μm. The reaction in the present invention is carried out in the aqueous medium, in which the amount of water charged is adjusted such that the concentration of the fine ferromagnetic particles is 40 to 65% by weight, preferably 43-60% by weight. If the concentration exceeds 60% by weight, it becomes difficult to obtain composite particles with a number-average particle diameter of from not less than 1 μm to less than 10 μm at a high yield. On the other hand, if the concentration of the fine ferromagnetic particles is less than 40% by weight, it is difficult to obtain the aimed composite particles.

In the case of using fine ferromagnetic particles subjected at the surface thereof to the hydrophobic treatment, the amount of water charged is preferably controlled such that the concentration of the fine ferromagnetic particles is from 35 to 95% by weight, more preferably from 50 to 90% by weight. If it is less than 35% by weight, it is difficult to obtain composite particles with a number-average particle diameter from not less than 1 μm to less than 10 μm at a high yield. If it exceeds 95% by weight, it is difficult to obtain the aimed composite particles.

In the reaction of the present invention, the temperature is gradually elevated under stirring at a rate of 0.5° to 1.5° C./min, preferably, 0.8° to 1.2° C./min and the reaction is conducted at a temperature from 70° to 90° C., preferably, 83° to 87° C. for 60 to 150 min, preferably, 80 to 110 min. In the reaction, curing also proceeds simultaneously with the reaction to form a matrix of the cured phenol resin. After the reaction, when the reaction product is cooled to lower than 40° C., an aqueous dispersion of composite particles in which fine ferromagnetic particles are uniformly dispersed in the matrix of the cured phenol resin can be obtained.

Subsequently, after filtering the aqueous dispersion and carrying out a solid-liquid separation in accordance with a customary method such as centrifugal separation, composite particles having fine ferromagnetic particles uniformly dispersed in the matrix of the phenol resin can be obtained by washing and drying.

In the reaction of the present invention, a suspension stabilizer may also be present if necessary. As the suspension stabilizer, there can be mentioned hydrophilic organic compounds such as carboxylmethyl cellulose and polyvinyl alcohol, and water-insoluble inorganic salts such as fluoro compounds, for example, calcium fluoride and calcium sulfate. Considering the dispersion of the fine ferromagnetic particles to the inside of the phenol resin matrix, calcium fluoride is preferred.

In the case of using the suspension stabilizer, the amount thereof is preferably from 0.2 to 10% by weight based on the phenols. If it is exceeds 10% by weight, the amount of the suspension stabilizer such as calcium fluoride remaining on the surface of the composite particle tends to be increased.

The magnetic particles according to the present invention is composite particles having a number-average particle diameter of from not less than 1 μm to less than 10 μm, an apparent density of not greater than 1.5 g/cm$^3$ and an electric resistivity of less than $10^{12}$ ohm.cm, preferably not greater than $10^9$ ohm.cm owing to the capability of increasing the content of the fine ferromagnetic particles, and showing an improved bondability between each of the fine ferromagnetic particles. Accordingly, they are most suitable as the magnetic particles used for the electrostatic latent image developed demanded most strongly at present.

Further, since the composite particles are excellent in the fluidity, they are more suitable as the magnetic particles used for the electrostatic latent image developer.

In addition, since the average particle diameter of the resultant composite particles can be controlled easily, composite particles having a number-average particle diameter of from not less than 1 μm to less than 10 μm can be obtained at a high yield without classification, etc. which is extremely useful from industrial and economical points of view.

Further, the magnetic particles in accordance with the present invention is applied not only to the electrostatic latent image developer but also to general application uses as the magnetic composite particles, that is, various application fields such as toner, paint, colorant such as ink, column filler, electromagnetic wave absorber, damping agent, etc.

EXAMPLE

The present invention will be explained in more details in the following examples, however, it should be recognized that the scope of the present invention is not restricted to these examples.

(1) A number-average particle diameter was a number-average value of diameter measured for 200 particles by optical microscopic photography.

(2) An apparent density was measured in accordance with the method as described in JIS K5 101.

(3) A saturation magnetization was measured by using "Vibration Specimen Type Magnetometer VSM-3S-15" (manufactured by Toei Industry Co.) at a external magnetic field of 10 KOe.

(4) A volumic electric resistance was measured by High Resistance Meter 4329A (manufactured by Yokogawa Hewlett-Packard, Ltd.).

(5) 50 g of composite particles were filled in a glass flask (opening: 75 ϕ, height: 75 mm, inner diameter at a conical portion: 6 ϕ, length for straight portion: 30 mm) and a particles falling time (sec) when applying a predetermined vibration, was determined. A fluidizing rate was shown as a value obtained by dividing the weight of the composite particles with the particles falling time described above.

(6) 0.2 g of fine ferromagnetic particles and 50 g of water were placed in an Erlenmeyer flask of 500 cc volume, to which methanol was continuously added under stirring. Then, the point at which the initially separated ferromagnetic particles begun to settle and dispersed in water-methanol mixed solution was determined as a terminal point, the amount of methanol used up to that point was determined and the degree is shown by the value calculated by substituting the data into the following equation.

$$\text{Hydrophobic degree (\%)} = \frac{(\text{Amount of methanol})}{\left(\begin{array}{c}\text{Amount of}\\ \text{water (50 g)}\end{array}\right) + \left(\begin{array}{c}\text{Amount of}\\ \text{methanol}\end{array}\right)} \times 100$$

EXAMPLE 1

To a one liter three-necked flask, were charged 30 g of phenol, 60 g of 37% formalin, 400 g of spherical magnetite with an average particle diameter of 0.24 μm, 12 g of an aqueous 25% ammonia and 280 g of water (corresponding to 51% by weight of concentration of the fine ferromagnetic particles) under stirring. After stirring for a while at a room temperature, the temperature was elevated to 85° C. for 40 min under stirring and reaction were conducted at that temperature for 180 min to form composite particles comprising magnetite and a cured phenol resin.

Then the content in the flask was cooled to 30° C. and, after adding 0.5 liter of water, supernatant was removed and, further, the composite particles in the lower layer were washed with water and then dried in air. Subsequently, the obtained composite particles were dried under a reduced pressure (less than 5 mmHg) at 50° to 60° C. to obtain spherical composite particles (hereinafter referred to as composite particles A). The properties thereof are shown in Table 2.

EXAMPLE 2

Reaction and after-treatment were conducted in the same procedures as those in Example 1 except for using 8 g of hexamethylene tetramine instead of 12 g of the aqueous 25% ammonia as the basic catalyst to obtain spherical composite particles (hereinafter referred to as composite particles B). Table 1 shows the principal production conditions and Table 2 shows various properties of the resultant composite particles.

EXAMPLES 3-7, COMPARATIVE EXAMPLES 1, 2

Reaction and after-treatment were conducted in the same procedures as those in Example 1 except for changing the kind, the amount and the concentration of the fine ferromagnetic particles variously as shown in Table 1 (the composite particles in the Example 3-7 and the Comparative Example 1 are referred to, respectively, as composite particles C-H). Table 1 shows the principal production conditions and Table 2 shows various properties of the resultant composite particles.

FIG. 1 shows the scanning electron microscope photograph (×10,000) for the resultant composite particles C obtained in Example 3.

In Comparative Example 2, no composite particles were obtained and a great amount of fine ferromagnetic particles were suspended in liquid.

EXAMPLE 8

After charging 400 g of spherical magnetite with an average particle diameter of 0.24 μm into a Henshel mixer and stirring sufficiently, 2 g of a titanates coupling agent (Plainact TTS: manufactured by Ajinomoto Co.) was added, the temperature was elevated up to about 100° C. and they were mixed and stirred sufficiently for about 30 min.

50 g of phenol, 75 g of an aqueous 37% formalin, 400 g of magnetite applied with the hydrophobic treatment, 18 g of an aqueous 28% ammonia and 150 g of water (corresponding to 57.7% by weight of the concentration of fine ferromagnetic particles) were charged under stirring into a one liter three-necked flask, and the temperature was elevated to 85° C. for 40 min and reaction was conducted at a temperature for 180 min to obtain composite particles comprising spherical magnetite and a cured phenol resin.

Then, the content in the flask was cooled to 30° C. and, after adding 0.5 liter of water, the supernatant was removed and, further, the composite particles in the lower layer were washed with water and then dried in air. Subsequently, the obtained composite particles were dried under a reduced pressure (less than 5 mmHg) at 50°-60° C. to obtain spherical composite particles (hereinafter referred to as composite particles I).

Figure 2:
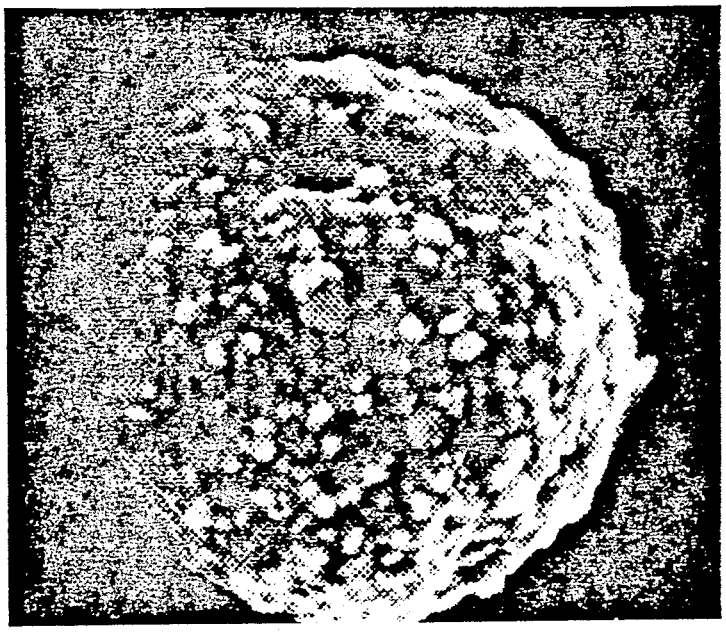

FIG. 2 shows a scanning electron microscope photograph (×10,000) for the resultant composite particles I and Table 4 shows various properties of them.

EXAMPLES 9-14

Composite particles were obtained in the same procedures as those in Example 8 except for changing the kind of the fine ferromagnetic particles, the kind and the amount of the hydrophobic treating agent used, the kind and the amount of the basic catalyst, the amount of phenols, the amount of aldehyde and the amount of water variously (the composite particles obtained in Examples 9-14 are hereinafter referred to as composite particles J-O respectively).

Table 3 shows the principal production conditions and Table 4 shows various properties of the composite particles.

APPLICATION EXAMPLE

Developers were prepared by mixing each 25 parts by weight of composite particles A-O obtained in Examples 1-14 and Comparative Example 1 described above with 100 parts by weight of commercially available magnetic toner. Then, when copying was conducted to common paper in an electrophotographic copying machine using Se as photosensitive material by using developers containing composite particles A-G and I-O respectively obtained in Examples 1-14, clear copy image with no blanking could be obtained in any of the cases. On the other hand, white spots referred to as white blanking were shown in the developer containing composite particles H of Comparative Example 1.

TABLE 1

| Examples and Comparative Examples | Production reaction of composite particles: Fine ferromagnetic particles: Kind | Average particle diameter (μm) | Amount (g) | Concentration (wt %) | Basic catalyst: Kind | Amount (g) [molar ratio] | Phenols: Kind | Phenols: Amount (g) | Aldehydes: Amount (g) | Water (g) | Composite particles |
|---|---|---|---|---|---|---|---|---|---|---|---|
| Example 1 | Spherical magnetite | 0.24 | 400 | 51 | 25% aqueous ammonia | 12 [0.55] | Phenol | 30 | 60 | 280 | A |
| Example 2 | Spherical magnetite | 0.24 | 400 | 51 | Hexamethylene-tetramine | 18 [0.40] | " | 30 | 60 | 280 | B |
| Example 3 | Poly-hedel magnetite | 0.26 | 400 | 56 | 25% aqueous ammonia | 12 [0.55] | " | 30 | 60 | 200 | C |
| Example 4 | Zn added spherical magnetite | 0.25 | 400 | 45 | 25% aqueous ammonia | 12 [0.55] | " | 30 | 60 | 380 | D |
| Example 5 | Ni—Zn | 0.22 | 400 | 56 | 25% aqueous | 12 | " | 30 | 60 | 200 | E |

TABLE 1-continued

| Examples and Comparative Examples | Production reaction of composite particles: Fine ferromagnetic particles: Kind | Average particle diameter (μm) | Amount (g) | Concentration (wt %) | Basic catalyst: Kind | Amount (g) [molar ratio] | Phenols: Kind | Phenols: Amount (g) | Aldehydes Amount (g) | Water (g) | Composite particles |
|---|---|---|---|---|---|---|---|---|---|---|---|
| | added Spherical magnetite | | | | ammonia | [0.55] | | | | | |
| Example 6 | Ni—Zn added Spherical magnetite | 0.23 | 400 | 51 | 25% aqueous ammonia | 12 [0.55] | " | 30 | 60 | 280 | F |
| Example 7 | Spherical gamma iron oxide | 0.25 | 400 | 49 | 25% aqueous ammonia | 12 [0.55] | " | 30 | 60 | 300 | G |
| Comparative Example 1 | Spherical magnetite | 0.24 | 400 | 70 | 25% aqueous ammonia | 6 [0.28] | " | 15 | 30 | 120 | H |
| Comparative Example 2 | Spherical magnetite | 0.24 | 400 | 35 | 25% aqueous ammonia | 20 [0.92] | " | 50 | 100 | 570 | — |

TABLE 2

| Examples and Comparative Example | Composite particles | Number average particle diameter (μm) | Apparent density (g/cm³) | Content of fine ferromagnetic particles (wt %) | Saturation magnetization (emu/g) | Volumic electric resistivity (Ω · cm) |
|---|---|---|---|---|---|---|
| Example 1 | A | 3 | 0.52 | 92 | 78 | $6.0 \cdot 10^{8}$ |
| Example 2 | B | 7 | 0.89 | 86 | 73 | $3.7 \cdot 10^{6}$ |
| Example 3 | C | 5 | 0.80 | 87 | 74 | $4.2 \cdot 10^{5}$ |
| Example 4 | D | 3 | 0.65 | 82 | 71 | $2.3 \cdot 10^{10}$ |
| Example 5 | E | 3 | 0.52 | 93 | 72 | $1.7 \cdot 10^{11}$ |
| Example 6 | F | 4 | 0.54 | 93 | 61 | $1.5 \cdot 10^{9}$ |
| Example 7 | G | 8 | 0.60 | 92 | 68 | $1.6 \cdot 10^{9}$ |
| Comparative Example 1 | H | 20 | 1.42 | 95 | 80 | $1.9 \cdot 10^{8}$ |

TABLE 3

| Examples | Production reaction of composite particles: Fine ferromagnetic particles: Kind | Average particle diameter (μm) | Treatment with hydrophobic treating agent: Kind of hydrophobic treating agent | Amount processed (wt %) | Hydrophobic degree (%) | Amount (g) | Concentration (%) |
|---|---|---|---|---|---|---|---|
| Example 8 | Spherical magnetite | 0.24 | Titanates coupling agent (Plainact TTS, mfd Ajinomoto Co.) | 0.5 | 52 | 400 | 57.7 |
| Example 9 | Spherical magnetite | 0.24 | Titanates coupling agent (Plainact TTS, mfd. Ajinomoto Co.) | 0.25 | 29 | 400 | 54.4 |
| Example 10 | Spherical magnetite | 0.24 | Titanates coupling agent (Plainact TTS, mfd. Ajinomoto Co.) | 0.5 | 52 | 400 | 57.7 |
| Example 11 | Polyhedel magnetite | 0.26 | Titanates coupling agent (Plainact TTS, mfd Ajinomoto Co.) | 0.25 | 26 | 400 | 53.8 |
| Example 12 | Zn added spherical magnetite | 0.25 | Titanates coupling agent (Plainact TTS, mfd. Ajinomoto Co.) | 0.5 | 50 | 400 | 53.8 |
| Example 13 | Spherical gamma iron oxide | 0.24 | Silanes coupling agent (KBM-6000, mfd. Shinetsu Kagaku Kogyo K.K.) | 0.5 | 48 | 400 | 57.7 |
| Example 14 | Spherical magnetite | 0.24 | Silanes coupling agent (KHM-503, mfd. Shinetsu Kagaku Kogyo K.K.) | 0.5 | 30 | 400 | 53.8 |

Production reaction of composite particles

Basic catalyst

TABLE 3-continued

| Examples | Kind | Amount (g) [molar ratio] | Phenols Kind | Phenols Amount (g) | Aldehydes Amount (g) | Water (g) | Composite particles |
|---|---|---|---|---|---|---|---|
| Example 8 | 28% aqueous ammonia | 18 [0.56] | Phenol | 50 | 75 | 150 | I |
| Example 9 | Hexamethylenetetramine | 30 [0.40] | " | 50 | 75 | 200 | J |
| Example 10 | 28% aqueous ammonia | 18 [0.56] | " | 50 | 75 | 150 | K |
| Example 11 | 28% aqueous ammonia | 18 [0.56] | " | 50 | 75 | 200 | L |
| Example 12 | 28% aqueous ammonia | 18 [0.56] | " | 50 | 75 | 200 | M |
| Example 13 | 28% aqueous ammonia | 18 [0.56] | " | 50 | 75 | 150 | N |
| Example 14 | 28% aqueous ammonia | 18 [0.56] | " | 50 | 75 | 200 | O |

TABLE 4

| Examples | Composite particles | Number average particle diameter (μm) | Apparent density (g/cm³) | Content of fine ferromagnetic particles (wt %) | Saturation magnetization (emu/g) | Volumic electric resistivity (Ω · cm) | Fluidizing rate (g/sec) |
|---|---|---|---|---|---|---|---|
| Example 8 | I | 7 | 0.75 | 90 | 77 | $8.2 \cdot 10^8$ | 0.64 |
| Example 9 | J | 3 | 0.55 | 91 | 78 | $7.0 \cdot 10^8$ | 0.54 |
| Example 10 | K | 5 | 0.57 | 93 | 80 | $3.8 \cdot 10^7$ | 0.78 |
| Example 11 | L | 4 | 0.62 | 87 | 74 | $6.7 \cdot 10^6$ | 0.50 |
| Example 12 | M | 6 | 0.57 | 83 | 70 | $5.1 \cdot 10^8$ | 0.52 |
| Example 13 | N | 3 | 0.60 | 91 | 67 | $1.5 \cdot 10^9$ | 0.52 |
| Example 14 | O | 5 | 0.62 | 90 | 78 | $2.0 \cdot 10^7$ | 0.56 |

What is claimed is:

1. Magnetic particles suitable for use as an electrostatic latent image developer, said magnetic particles comprising composite particles containing from more than 80% by weight to not more than 99% by weight of fine ferromagnetic particles and a cured phenol resin, and having a number-average particle diameter of from not less than 1 μm to less than 10 μm, an apparent density of not greater than 1.5 g/cm³ and a volumic electric resistivity of less than $10^{12}$ ohm.cm.

2. Magnetic particle according to claim 1, wherein said fine ferromagnetic particles are fine ferro magnetic particles subjected at the surface thereof to a hydrophobic treatment.

3. Magnetic particles according to claim 2, wherein a fluidizing rate of the composite particles is not less than 0.45 g/sec.

4. Magnetic particles according to claim 3, wherein a hydrophobic degree of said fine ferromagnetic particles treated is from 20 to 60% by weight.

* * * * *